US006286570B1

(12) United States Patent
Murray et al.

(10) Patent No.: US 6,286,570 B1
(45) Date of Patent: Sep. 11, 2001

(54) ADJUSTABLE ANTI-SPLITTING DEVICE

(75) Inventors: Norman E. Murray, Clarence Center; David H. Wagner, Lockport, both of NY (US); James A. Higgins, St. Mary, PA (US); Thomas D. Johel, Amherst, NY (US)

(73) Assignee: U•C Coatings Corporation, Buffalo, NY (US)

( * ) Notice: Subject to any disclaimer, the term of this patent is extended or adjusted under 35 U.S.C. 154(b) by 0 days.

(21) Appl. No.: 09/658,686

(22) Filed: Sep. 8, 2000

(51) Int. Cl.[7] ..... B27M 1/100; B25D 1/00

(52) U.S. Cl. ..... 144/329; 81/23; 81/176.1; 411/457; 411/477; 411/478

(58) Field of Search ..... 81/23, 176.1, 176.15; 144/329; 411/439, 461, 477, 457

(56) References Cited

U.S. PATENT DOCUMENTS

| | | | |
|---|---|---|---|
| 1,208,255 | 12/1916 | Williams | 411/457 |
| 1,737,908 | 12/1929 | Beegle | 411/461 |
| 1,925,238 | 9/1933 | Faries et al. . | |
| 2,080,962 | 5/1937 | Febrey . | |
| 2,223,596 | 12/1940 | Bowman, Jr. . | |
| 2,287,964 | 6/1942 | Beegle . | |
| 3,082,658 | 3/1963 | Young . | |
| 4,486,999 | 12/1984 | Bayne | 52/514 |
| 5,244,328 | 9/1993 | Higgins | 411/477 |

*Primary Examiner*—W. Donald Bray
(74) *Attorney, Agent, or Firm*—Hodgson Russ LLP

(57) ABSTRACT

The anti-splitting device of the present invention has a central-web portion and a pair of end web portions, which are joined adjacent to their midpoints to opposite ends of the central web portion to provide the device with generally I-shaped cross-sectional configurations. The web portions have first side edges tapered to define a cutting edge and second side edges serving to define a planar driven surface disposed parallel to the cutting edge. And on the central web portion are at least two projections to upstand from driven surface. The projections are adapted to removably attach the device to a driver employed to insert the device into a log. The driver of the present invention is preferably in the form of a manually operational hammer having a planar driver surface of circular plan form configuration and a circular groove that has an outer diameter equidistant and an inner diameter equidistant from a given fixed point, the center of the planar driving surface. The groove receives the projections and contacts a predetermined portion of the projections; the projections exert a force on either the outer diameter or the inner diameter, and do not contact both diameters at the same time. The device can then be freely rotated in the groove to obtain a desired position on the driver surface.

20 Claims, 2 Drawing Sheets

ADJUSTABLE ANTI-SPLITTING DEVICE

FIELD OF THE INVENTION

The present invention relates to an anti-splitting device for logs.

BACKGROUND OF THE INVENTION

End splits in logs are a serious problem because they downgrade the logs and seriously decrease their value. A current method used to lessen the damage is to drive various types of anti-splitting devices into the end of a log in accordance with the teachings for instance of U.S. Pat. Nos. 1,208,255; 1,737,908; 1,925,238; 2,080,962; 2,223,596; 2,287,964; 3,082,658; 4,486,999; and 5,244,328; and German Patent 368,020.

Prior to the '328 patent, previous anti-splitting devices posed several problems, namely, they are difficult to install, and being conventionally formed of steel, they cause "rust spotting" of the wood of a log adjacent to their points of insertions and they must be removed prior to further processing of the log in order to avoid damage to saws, veneer knives, etc.

The '328 patent redesigned anti-splitting devices to solve these other problems of previous anti-splitting devices. Applicant recognized the superiority of the '328 patent and therefore became the exclusive worldwide licensee of the '328 patent. While using the anti-splitting device of the '328 patent, Applicant discovered some problems with it.

The '328 patent relates to an anti-splitting device preferably molded from a recycled plastic material. The device has a central web portion and a pair of end web portions, which are joined adjacently to their midpoints to opposite ends of the central web portion to provide the device with generally I-shaped cross-sectional configurations. Each web portion has first side edges tapered to define a cutting edge and second side edges serving to define a planar driven surface disposed parallel to the cutting edge. When the second side edges are formed, it is preferable to provide integrally formed radiused filler portions joined to the web portions adjacent their junctures and to arrange projections to upstand from a driven surface adjacent such junctures. The projections are adapted to removably attach the device to a driver employed to insert the device into a log.

The driver of the '328 patent is preferably in the form of a manually operational hammer having a planar driver surface of circular planar form configuration and a plurality of pairs of recesses positioned near the outer perimeter of the driver surface. The recesses open through the driver surface and serve to slidably, frictionally receive each surface of the projections and to selectively orient the device relative to the driver surface and thus the end of a log into which the device is to be driven upon swinging of the driver.

A problem with the '328 anti-splitting device is that the projections sometimes get stuck in the pair of recesses since the recesses frictionally contact each surface of the projections. When this occurs, the projections have to be physically removed with another instrument, like an awl, before a second anti-splitting device can be inserted into that pair of recesses. This additional step of removing the projections is not desired.

Another problem with the '328 anti-splitting device is that sometimes the device cannot be positioned into the desired position in the log without altering the position of the user, or moving the log—which could be too heavy to move—because the recesses are not positioned correctly.

To overcome these problems, applicant has designed the instant invention.

SUMMARY OF THE INVENTION

The anti-splitting device of the present invention has a central web portion and a pair of end web portions, which are joined adjacently at their midpoints to opposite ends of the central web portion to provide the device with generally I-shaped cross-sectional configurations. The web portions have first side edges tapered to define a cutting edge and second side edges serving to define a planar driven surface disposed parallel to the cutting edge. And on the central web portion are at least two projections to upstand from a driven surface. The projections are adapted to removably attach the device to a driver employed to insert the device into a log.

The driver of the present invention is preferably in the form of a manually operational hammer having a planar driver surface of circular plan form configuration and a circular groove that has an outer diameter equidistant and an inner diameter equidistant from a given fixed point, the center of the planar driving surface. The groove receives the projections and contacts a predetermined portion of the projections; the projections exert a force on either the outer diameter or the inner diameter, and do not contact both diameters at the same time. The device can then be freely rotated in the groove to obtain a desired position on the driver surface. Thus, the device can be driven into the end of a log upon swinging of the driver, and the projections will not remain in the groove, if they happen to break off.

BRIEF DESCRIPTION OF THE DRAWINGS

The nature and mode of operation of the present invention will now be more fully described in the following detailed description taken with the accompanying drawings wherein.

DETAILED DESCRIPTION

Figure 1:
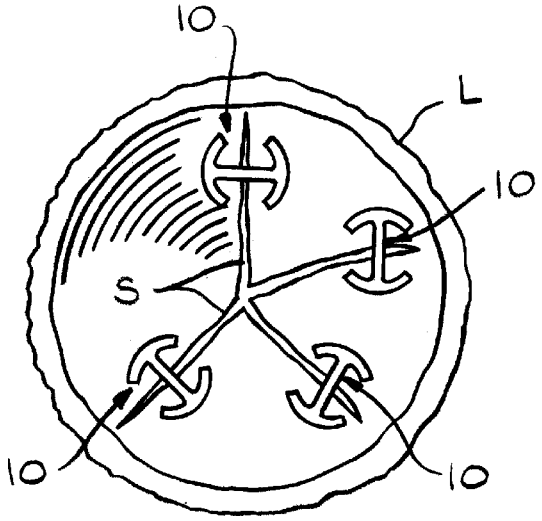
FIG. 1 is an end view of a log showing anti-splitting devices of the present invention inserted there into.
Figure 3:
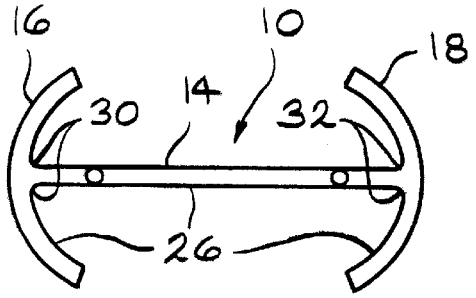
FIG. 3 is a top plan view of the device shown in FIGS. 1 and 2.
Figure 2:
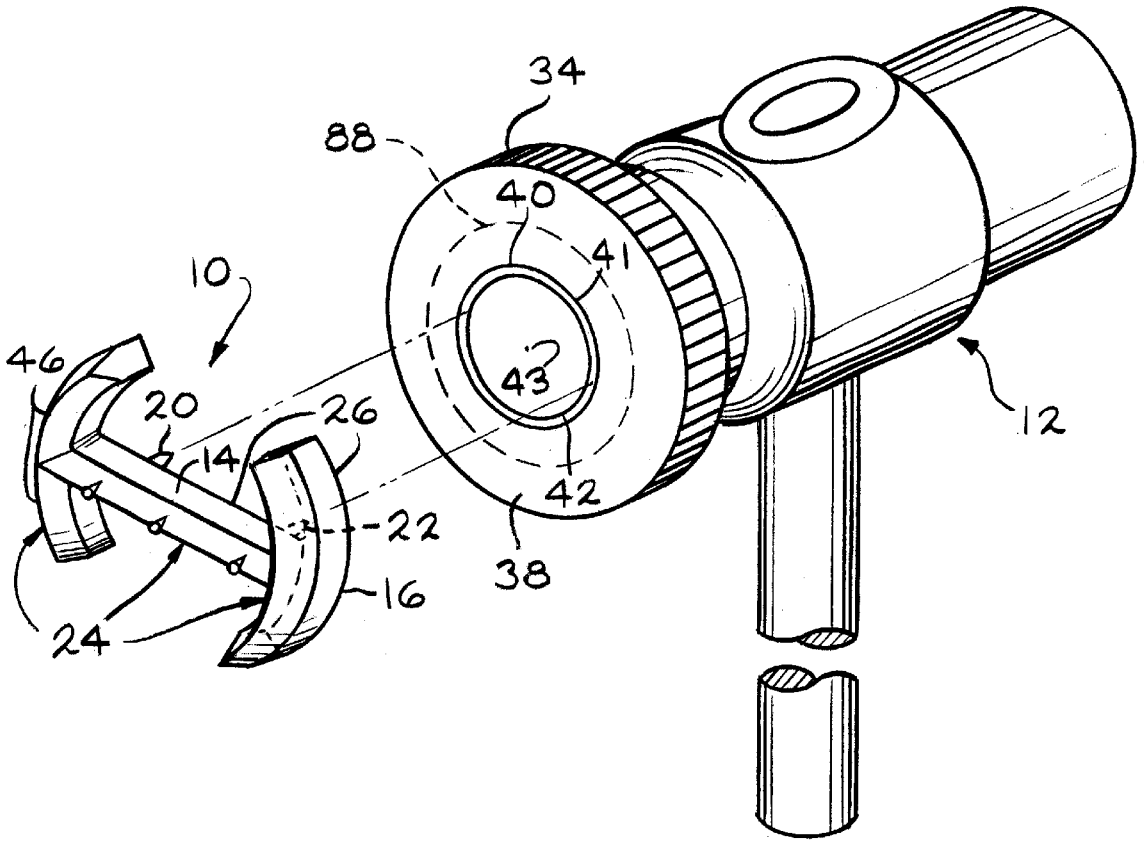
FIG. 2 is an exploded, perspective view illustrating a mode of releasably mounting the anti-splitting device on a driver.

Reference is first made to FIGS. 1 and 2, wherein an anti-splitting device of the present invention is generally designated as 10, and shown as inserted into an end of a log L for purposes of minimizing or preventing enlargement of splits S, and in association with a driver 12 adapted for use in manually driving the device into such logs.

Device 10 is best shown in FIGS. 2–7 as generally including a central web portion 14 and a pair of end web portions 16 and 18. The end portions 16, 18 are joined at their respective mid-points to opposite ends of the central web portion 14. And on the central web portion 14 are at least two and preferably a pair of projections 20 and 22, which serve to orient and removably attach the device 10 to driver 12 in the manner to be described.

Web portions 14, 16 and 18 are considered to have first and second or opposite side edges 14*a* and 14*b*, 16*a* and 16*b*, and 18*a* and 18*b*. The first side edges 14*a*, 16*a* and 18*a* are tapered, best shown in FIGS. 4 and 5, to define a cutting edge 24. And the second side edges 14*b*, 16*b* and 18*b* are essentially coplanar and cooperate to define a driven surface 26, best shown in FIGS. 3 and 4, disposed essentially parallel to cutting edge 24.

In a presently preferred and commercially available form of device 10, web portions 16 and 18 are semi-circular and the facing surfaces of such end web portions 16 and 18 are generally concave. Moreover, projections 20 and 22 are integrally mold formed from plastic material, as opposed to being formed of metal. By using plastic, the device 10 avoids discoloration or "rust spotting" of those portions of the wood of a log adjacent the area into which the device 10 is driven by driver 12, and permits subsequent cutting operations to be performed on the log without need for prior removal of the device 10 therefrom. When so formed, it is preferable to provide integrally formed radiused filler portions 30 and 32 joined to web portions 14, 16 and 18 adjacent their junctures. Filler portions 30 and 32 have proven effective in minimizing structural failure of device 10 adjacent the junctures of web portion 14 with web portions 16 and 18 incident to the driving of device 10 into a log.

Figure 4:
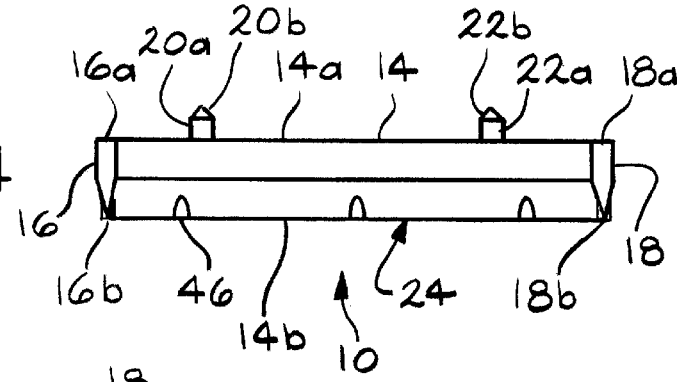
FIG. 4 is a side elevational view thereof.
Figure 5:
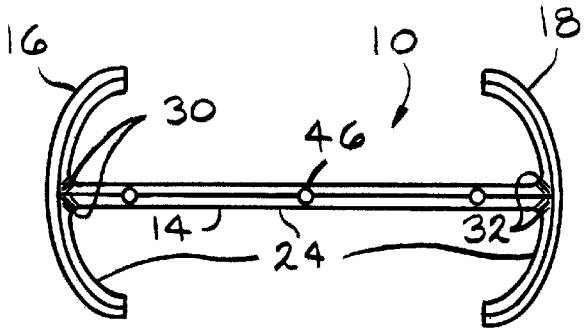
FIG. 5 is a bottom plan view thereof.

On the central web portion 14, at a predetermined distance, are projections 20 and 22 to upstand from driven surface 26, as best shown in FIG. 4. Projections 20 and 22 may be variously configured, but they are preferably shaped to define generally cylindrical base portions 20*a* and 22*a* and rounded or generally conical free end or guide portions 20*b* and 22*b*.

Driver 12 is shown in FIG. 2 as being in the form of a hammer 12 having a weighted head 34 and a manually manipulated handle 36, wherein head 34 is provided with a planar driver surface 38. On the planar driver surface is a circular groove 40. The circular groove 40 has an outer diameter 41 equidistant and an inner diameter 42 equidistant from a given fixed point, the center 43 of the planar driving surface 38. The groove 40 receives the projections 20, 22 and contacts a predetermined portion of the projections 20, 22. In order for the device 10 to remain attached to the hammer 12, the projections 20, 22 exert a force on either the outer diameter 41 or the inner diameter 42, and do not contact both diameters 41, 42 at the same time. Thus, if the projections 20, 22 become detached from the device 10, the projections 20, 22 do not remain in the groove 40; instead detached projections 20, 22 merely fall to the ground in the present invention.

The distance of the projections 20, 22 on the central web portion 14 correspond to the diameter of the inner diameter 42 or the outer diameter 41. It has been determined that placing the groove 40 near the perimeter of the planar driver surface 38, as disclosed in the '328 patent, is not preferred. Instead, the groove 40 should be firmly in the interior 88 portion, as shown in FIG. 2, of the planar driver surface 38. Otherwise, the device 10 will be more difficult to rotate and properly align.

Moreover, when the projections are within the groove 40, the device 10 can be orientated in the desired position without removing or lifting the device 10 from the driver surface 38. Also it allows the user to obtain the desired position of the device 10 every time without having to adjust the user's position as well.

As with prior log anti-splitting devices, devices 10 would normally be applied to logs resting on the ground in the field or in a log collection area prior to transport of the logs to a point at which they are intended to be cut into lumber or veneer. For the case of devices of the '328 patent, it was necessary for a Worker to manually position a device on the planar driver surface into the correct recesses, and since splits are randomly arranged, it was normally necessary for the worker to change his position relative to the log after each insertion operation.

In accordance with the present invention, device 10 may be inserted into log L without the requirement of a worker to adjust his position relative to the log. Specifically, it is contemplated that each insert 10, after being temporarily attached to the driver surface 38 by means of projections 20 and 22 and then rotated while still attached to the driver surface 38 to obtain the desired position of the device 10 into the log, may be driven into log L by a single backhand or underhand swing of driver 12. Care should be exercised by a worker to ensure that the driver surface is arranged essentially at right angles to the direction of the grain of the log, during the terminal portion of the swing of the driver, to thereby ensure that the device is driven fully into the log in a direction parallel to its grain. Rebound or bounce back of the driver serves to disengage the inserted device therefrom. Like swings are employed to drive additional devices 10 into log L with their orientation relative thereto and to each other being determined by the pre-positioning of projections 20 and 22 of such devices 10 within the circular groove 40 and rotating the devices 10 while in the groove 40 to obtain the desired position.

As by way of example of a present commercial form of the invention, device 10 shown in FIGS. 1–7, has a central and end web portions having lengths of about 3¾, 2 and 1 inches, respectively, thicknesses of about 3⁄64 inch, and widths, as measured between their side edges, of about ½ inch. When anti-splitting devices of the present invention are intended for use with a flitch or cant, as opposed to a log, the lengths of the web portions of such devices would be reduced by about one half with their web portion thicknesses and widths remaining essentially the same. Enlargements 46 located in the area cutting edge 24 occur as a result of the device mold forming operation, and do not appear to adversely affect driving of the device into a log.

While the anti-splitting device of the present invention may be cast from metal, it is preferably integrally mold formed from recycled plastic material, like polycarbonate.

Figure 6:
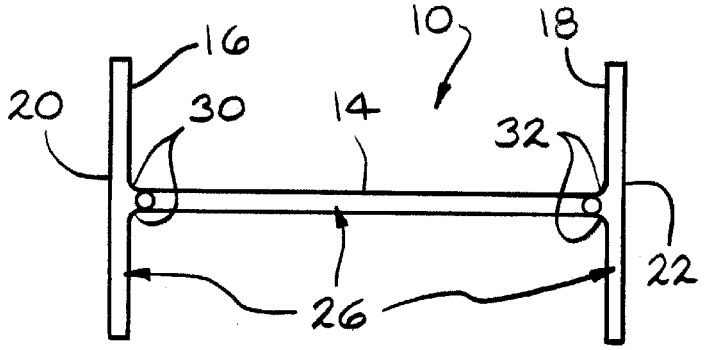
FIG. 6 is a top plan view of an alternative form of the device.
Figure 7:
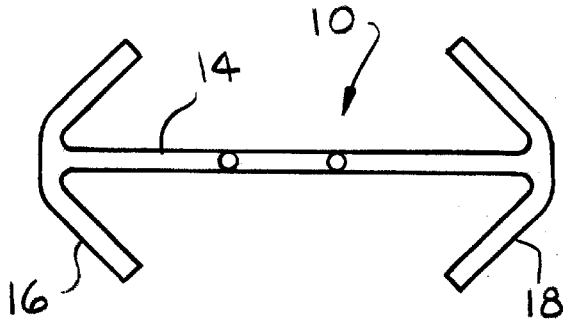
FIG. 7 is a top plan view of a further alternative form of the device.

FIGS. 6 and 7 illustrate alternative anti-splitting devices 10 wherein their end web portions 16 and 18 are right angled to form a letter "I" and V-shaped, respectively. Collectively, all device 10 embodiments described in this application are referred to as "I-shaped plan view configurations." These embodiments are excellent alternatives to those shown in FIGS. 3–5 and obtain similar or superior results.

The anti-splitting device of the present invention has been disclosed for use with a manually operated hammer having a groove. However, it is contemplated that the device would have utility with a portable electrically or pneumatically powered driver, where a suitable source of power is available, and for this latter case the driver would only require one pair of device positioning recesses, if the driver could be conveniently positioned to vary the orientation of the devices, as presented to an end of a log.

It is intended that the above description of the preferred embodiments of the structure of the present invention and the description of its operation are but one or more enabling best mode embodiments for implementing the invention. Other modifications and variations are likely to be conceived of by those skilled in the art upon a reading of the preferred embodiments and a consideration of the appended claims and drawings. These modifications and variations still fall within the breadth and scope of the disclosure of the present invention.

We claim:

1. A system for minimizing end splits in a log comprising:

an anti-splitting device having a central web portion; a pair of end web portions joined adjacent midpoints thereof to opposite ends of the central web portion to provide the anti-splitting device with a generally I-shaped plan view configuration, the web portions having oppositely facing first and second side edges, the first side edges being tapered to define a cutting edge to facilitate insertion of the anti-splitting device into the log, the second side edges being essentially coplanar and parallel to the cutting edge to define a driven surface to which force may be applied to the anti-splitting device for inserting the cutting edge into the log; and at least two projections upstanding from the driven surface; and a driving instrument for inserting the anti-splitting device into a log, having a driving surface with a circular groove having an outer diameter and an inner diameter, wherein the circular groove receives the at least two projections, which are sized and arranged for slidable frictional contact with either the outer diameter or the inner diameter, and wherein the circular groove allows the anti-splitting device to be rotated while frictionally contacted to the driving surface to obtain the desired position of the anti-splitting device in relation to the log.

2. The system of claim 1 wherein the projections upstand from the driven surface adjacent the opposite ends of the central web portion.

3. The system of claim 1 wherein the projections upstand from the driven surface on the cental web portion.

4. The system of claim 1 wherein the projections are parallel posts having cylindrical base portions and rounded free ends portions.

5. The system of claim 1 wherein radiused filler portions are joined to the web portions at the junctures thereof.

6. The system of claim 5 wherein the projections are post upstanding from the driven surface at said junctures of the web portions.

7. The system of claim 1 wherein the web portions are planar and joined in a right angular relationship, and radiused filler portions are joined to said web portions at the junctures thereof.

8. The system of claim 1 wherein the circular groove is equidistant from a given fixed point, the center of the driving surface.

9. The system of claim 1 wherein the driving surface is of generally circular planar view configuration and planar.

10. The system of claim 1 wherein the projections exert a force on the exterior diameter.

11. The system of claim 1 wherein the projections exert a force on the interior diameter.

12. The system of claim 1 wherein when the projections detach from the anti-splitting device, the detached projections do not remain in the circular groove.

13. A method for minimizing end splits in a log comprising the steps of:

inserting an anti-splitting device into a driving instrument;

rotating the anti-splitting device while attached to the driving instrument into a desired position;

driving the anti-splitting device across the end splits;

wherein the anti-splitting device has a central web portion; a pair of end web portions joined adjacent midpoints thereof to opposite ends of the central web portion to provide the anti-splitting device with a generally I-shaped plan view configuration, the web portions having oppositely facing first and second side edges, the first side edges being tapered to define a cutting edge to facilitate insertion of the anti-splitting device into the log, the second side edges being essentially coplanar and parallel to the cutting edge to define a driven surface to which force may be applied to the anti-splitting device for inserting the cutting edge into the log; and at least two projections upstanding from the driven surface; and wherein the driving instrument has a driving surface with a circular groove having an outer diameter and an inner diameter; the circular groove receives the at least two projections, which are sized and arranged for slidable frictional contact with either the outer diameter or the inner diameter; and the circular groove allows the anti-splitting device to be rotated while frictionally contacted to the driving surface to obtain the desired position of the anti-splitting device in relation to the log.

14. The method of claim 13 wherein the projections upstand from the driven surface adjacent the opposite ends of the central web portion.

15. The method of claim 13 wherein the projections upstand from the driven surface on the cental web portion.

16. The method of claim 13 wherein the circular groove is equidistant from a given fixed point, the center of the driving surface.

17. The method of claim 13 wherein the driving surface is of generally circular planar view configuration and planar.

18. The method of claim 13 wherein the projections exert a force on the exterior diameter.

19. The method of claim 13 wherein the projections exert a force on the interior diameter.

20. The method of claim 13 wherein when the projections detach from the anti-splitting device, the detached projections do not remain in the circular groove.

* * * * *